US012345257B2

(12) United States Patent
Yang et al.

(10) Patent No.: US 12,345,257 B2
(45) Date of Patent: Jul. 1, 2025

(54) COMPRESSOR AND A DYNAMIC VORTEX DISK THEREOF

(71) Applicant: Robert Bosch GmbH, Stuttgart (DE)

(72) Inventors: Devin Yang, Shanghai (CN); Haixiang Wang, Shanghai (CN); Xiaofeng Gu, Shanghai (CN)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/656,749

(22) Filed: May 7, 2024

(65) Prior Publication Data

US 2024/0401592 A1 Dec. 5, 2024

(30) Foreign Application Priority Data

Jun. 1, 2023 (CN) ..... 202310644855.7

(51) Int. Cl.
*F04C 18/02* (2006.01)
*F04C 29/00* (2006.01)
*F04C 29/12* (2006.01)

(52) U.S. Cl.
CPC ..... *F04C 18/0215* (2013.01); *F04C 18/0284* (2013.01); *F04C 18/0292* (2013.01); *F04C 29/00* (2013.01); *F04C 29/12* (2013.01)

(58) Field of Classification Search
CPC ..... F04C 18/0215; F04C 2240/30; F04C 18/0292; F04C 29/00; F04C 2240/20; F04C 18/0246; F04C 29/12; F04C 2210/26; F04C 2240/10; F04C 2240/50; F04C 2240/60; F04C 18/0284; F04C 27/005; F05B 2210/14; F05B 2240/60; F05B 2240/10; F05B 2240/20; F05B 2240/50
See application file for complete search history.

(56) References Cited

U.S. PATENT DOCUMENTS 5,505,595 A * 4/1996 Fukui ..... F04C 18/0215 418/55.6
5,611,674 A * 3/1997 Bass ..... F04C 27/005 417/220

(Continued)

FOREIGN PATENT DOCUMENTS

WO WO-2005010372 A1 * 2/2005 ..... F04C 18/0215

OTHER PUBLICATIONS

WO 2005/010372 (Year: 2005).*

*Primary Examiner* — Dapinder Singh
(74) *Attorney, Agent, or Firm* — Michael Best & Friedrich LLP

(57) ABSTRACT

A dynamic vortex disk for a compressor includes a dynamic substrate with a first side and a second side, and a dynamic vortex wall, which is integrally molded with the dynamic substrate, and extends around an axis of the dynamic substrate at the first side and away from the axis. The dynamic vortex wall further has an end surface opposite to the first side and away from the second side, and a groove deviating from a centerline of the dynamic vortex wall and formed on the end surface. The groove has a proximal end close to the axis of the dynamic substrate and an opposing distal end. An air supply channel is configured to extend along the axis through an interior of the dynamic vortex wall until it opens to the second side. The groove and the air supply channel are connected at the distal end.

11 Claims, 10 Drawing Sheets

(56) References Cited

U.S. PATENT DOCUMENTS

| | | | | |
|---|---|---|---|---|
| 8,998,595 | B2 * | 4/2015 | Ito | F04C 29/028 418/55.5 |
| 11,391,154 | B2 * | 7/2022 | Yang | F01C 21/006 |
| 11,879,460 | B2 * | 1/2024 | Ives | F04C 15/0019 |
| 2001/0048886 | A1 * | 12/2001 | Kuroki | F04C 27/005 418/55.4 |
| 2018/0128270 | A1 * | 5/2018 | Koyama | F25B 1/10 |
| 2018/0355866 | A1 * | 12/2018 | Bahrami | F04C 25/02 |
| 2020/0018313 | A1 * | 1/2020 | Sato | F04C 18/0215 |

* cited by examiner

COMPRESSOR AND A DYNAMIC VORTEX DISK THEREOF

BACKGROUND

The present application relates to a compressor for pressurizing a refrigerant and further relates to a dynamic vortex disk of a compressor.

A scroll compressor is provided with a dynamic vortex disk and a static vortex disk, and the dynamic vortex disk is driven by an eccentric shaft to revolve relative to the fixed static vortex disk without rotating, thereby forming a compression chamber for compressing a fluid between the dynamic vortex disk and the static vortex disk. On the side of the dynamic vortex disk opposite to the static vortex disk, there is a back pressure chamber. The pressure in the compression chamber exerts a compression thrust on the dynamic vortex disk and the pressure in the back pressure chamber exerts a back pressure thrust on the dynamic vortex disk. During the operation of the compressor, the pressure in the compression chamber and the pressure in the back pressure chamber vary dynamically. A thrust imbalance occurs when there is a difference in magnitude between the compression thrust and the back pressure thrust. For example, when the compression thrust is greater than the back pressure thrust, the end of the dynamic vortex disk will break contact with the static vortex disk, resulting in the leakage of the fluid being compressed. This reduces the efficiency of the compressor. In another example, when the compression thrust is less than the back pressure thrust, the dynamic vortex disk is pushed by the back pressure thrust such that the end of the dynamic vortex disk tightly abuts the static vortex disk, and when the compression thrust is substantially less than the back pressure thrust, the friction between the dynamic vortex disk and the static vortex disk becomes too high. This also reduces the efficiency of the compressor.

SUMMARY

One aspect of the present application is to provide a dynamic vortex disk that provides appropriate pressure on both sides thereof during rotation.

The dynamic vortex disk comprises a dynamic substrate with a first side and a second side opposite to each other; a dynamic vortex wall, which is integrally molded with the dynamic substrate, and extends around the axis of the dynamic substrate at the first side of the dynamic substrate and away from the axis, of which the dynamic vortex wall further has an end surface opposite to the first side and away from the second side; a groove deviating from the centerline of the dynamic vortex wall and formed on the end surface, which has a proximal end close to the axis of the dynamic substrate and an opposing distal end; an air supply channel configured to extend along the axis through the interior of the dynamic vortex wall until it opens to the second side, with the groove and the air supply channel connected at the distal end.

In one example of the dynamic vortex disk, the groove is configured such that its centerline deviates from the centerline of the vortex wall by a distance of not less than 0.1 times the thickness of the vortex wall.

In one example of the dynamic vortex disk, the width of the groove is no less than 0.1 times the thickness of the vortex wall and no more than 0.9 times the thickness of the vortex wall.

In one example of the dynamic vortex disk, the groove is configured to remain proximal to the radially relative inner side of the dynamic vortex wall from its proximal end to its distal end.

In one example of the dynamic vortex disk, the groove is further provided with a suction aperture at its proximal end, of which the suction aperture is configured such that its center coincides with the centerline of the vortex wall.

In one example of the dynamic vortex disk, the groove is further provided with a guiding port at its distal end, of which the guiding port is configured such that its diameter is greater than the width of the groove, its center coincides with the centerline of the vortex wall, and the air supply channel is aligned with the center of the guiding port.

In one example of the dynamic vortex disk, the groove is further provided with a sealing strip between its proximal end and its distal end, of which the groove has a cross-section with a stepped profile, wherein the stepped profile comprises a relatively narrow upper portion and a relatively wide lower portion, and the sealing strip is configured to fill the upper portion.

In one example of the dynamic vortex disk, the groove has a constant width throughout its depth.

The dynamic vortex disk of the present application has improved pressure balancing capabilities, enabling it to collect a greater volume and higher pressure of pressurized fluid on the first side and deliver it to the second side through the air supply channel. The groove for collecting fluid is provided eccentrically on the end surface of the dynamic vortex wall, allowing fluid from the side of the dynamic vortex wall close to the groove to enter into the groove. Thus, by designing the position and size of the slot, ideal pressure supplementation can be obtained to dynamically balance the pressure on both sides of the dynamic vortex disk.

Another aspect of the present application is to provide a compressor comprising a housing having an accommodating cavity; a static vortex disk fixed in the accommodating cavity, wherein the static vortex disk comprises an integrally molded static substrate and a static vortex wall, with a discharge outlet provided at the center of the static substrate; an intermediate disk fixed in the accommodating cavity; the dynamic vortex disk according to any one of the preceding examples, wherein the dynamic vortex disk is mounted between the static vortex disk and the intermediate disk, the end surface of the dynamic vortex wall is in sliding contact with the static substrate, and the side of the dynamic vortex wall is engaged with the side of the static vortex wall; a compression chamber formed between the static vortex disk and the first side of the dynamic vortex disk, with the compression chamber connected to the discharge outlet; and a back pressure chamber formed between the second side of the vortex disk and the intermediate disk, with the air supply channel connected to the back pressure chamber.

In one example of the compressor, the dynamic vortex disk is mounted on the main shaft of the compressor via an eccentric axis and moves along the axis between a first position and a second position, wherein in the first position, the end surface of the dynamic vortex wall abuts the static substrate; and in the second position, the end surface of the dynamic vortex wall is spaced apart from the static substrate, with the compression chamber connected to the back pressure chamber.

The compressor of the present application provides a dynamic pressure balance between the compression chamber and the back pressure chamber, and the high-pressure fluid introduced into the back pressure chamber from the compressor is able to quickly supplement the pressure of the back pressure chamber, thereby increasing the efficiency of the compressor.

Other aspects and features of the present application become apparent through the following detailed description with reference to the accompanying drawings. However, it should be noted that the accompanying drawings are designed for purposes of explanation only and are not intended to limit the scope of the present application, as they should be referenced in conjunction with the appended Claims. It should also be appreciated that the accompanying drawings are merely intended to conceptually illustrate the structures and processes described herein, and unless otherwise noted, are not necessarily drawn to scale.

BRIEF DESCRIPTION OF THE DRAWINGS

The present application will be more fully understood by referring to the detailed description of the specific embodiments below in conjunction with the accompanying drawings, in which the same reference numerals in the accompanying drawings always refer to the same elements depicted in the views. Wherein.

DETAILED DESCRIPTION

To help those skilled in the art accurately understand the subject matter claimed in the present application, the specific embodiments of the present application will be described in detail below in conjunction with the accompanying drawings.

Figure 1:
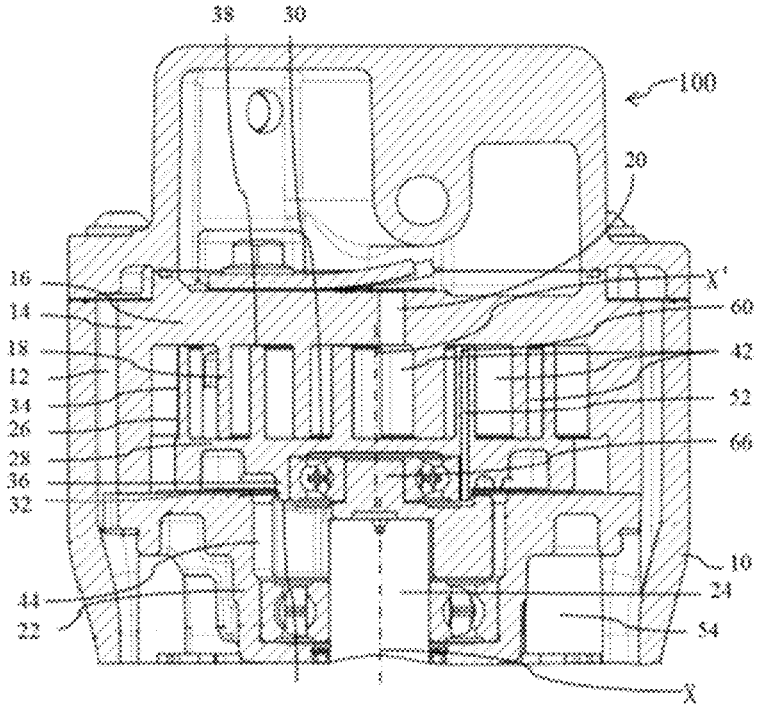
FIG. 1 is a schematic view of one example of a compressor related to the present application.

FIG. 1 is a schematic view of one example of a compressor related to the present application. The compressor 100 comprises a housing 10, a static vortex disk 14, an intermediate disk 22, a main shaft 24, and a dynamic vortex disk 26. The housing 10 defines an accommodating cavity 12. The static vortex disk 14 and the intermediate disk 22 are separately fixed in the accommodating cavity 12. The static vortex disk 14 comprises a static substrate 16 and a static vortex wall 18. The static substrate 16 and the static vortex wall 18 are integrally molded. A discharge outlet 20 is provided through the center of the static substrate 16.

A dynamic vortex disk 26 is mounted between the static vortex disk 14 and the intermediate disk 22. The dynamic vortex disk 26 comprises a dynamic substrate 28 and a dynamic vortex wall 34. The dynamic substrate 28 and the dynamic vortex wall 34 are integrally molded. The dynamic substrate 28 is equipped with a shaft seat 36 centered around an axis X'. The dynamic substrate 28 comprises a first side 30 and a second side 32 opposite each other along the axial direction. The dynamic vortex wall 34 is located on the first side 30 of the dynamic substrate 28. The shaft seat 36 is located on the second side 32. The dynamic vortex wall 34 extends from a position proximate to the axis X' towards a direction away from the axis X', i.e., starting from a position proximate to the axis X', the greater the angle at which the dynamic vortex wall 34 extends around the axis X', the greater the distance between the position to which it extends and the axis X'. In other words, the dynamic vortex wall 34 extends around the axis with a tendency to gradually move away from the axis X'.

The dynamic vortex wall 34 has an end surface 38 and two sides (not shown). In the direction of the axis X' of the dynamic vortex disk 26, the end surface 38 of the dynamic vortex wall 34 is located opposite the first side 30 and away from the second side 32. The sides of the dynamic vortex wall 34 are substantially parallel to the axis direction X'. The sides of the vortex wall 34 engage with the sides of the static vortex wall 18. The end surface 38 of the dynamic vortex wall 34 is in sliding contact with the static substrate 16. A compression chamber 42 is formed between the first side 30 of the dynamic vortex disk 26 and the static vortex disk 14, with the compression chamber 42 connected to the discharge outlet 20. A back pressure chamber 44 is formed between the intermediate disk 22 and the second side 32 of the dynamic vortex disk 26.

Figure 2:
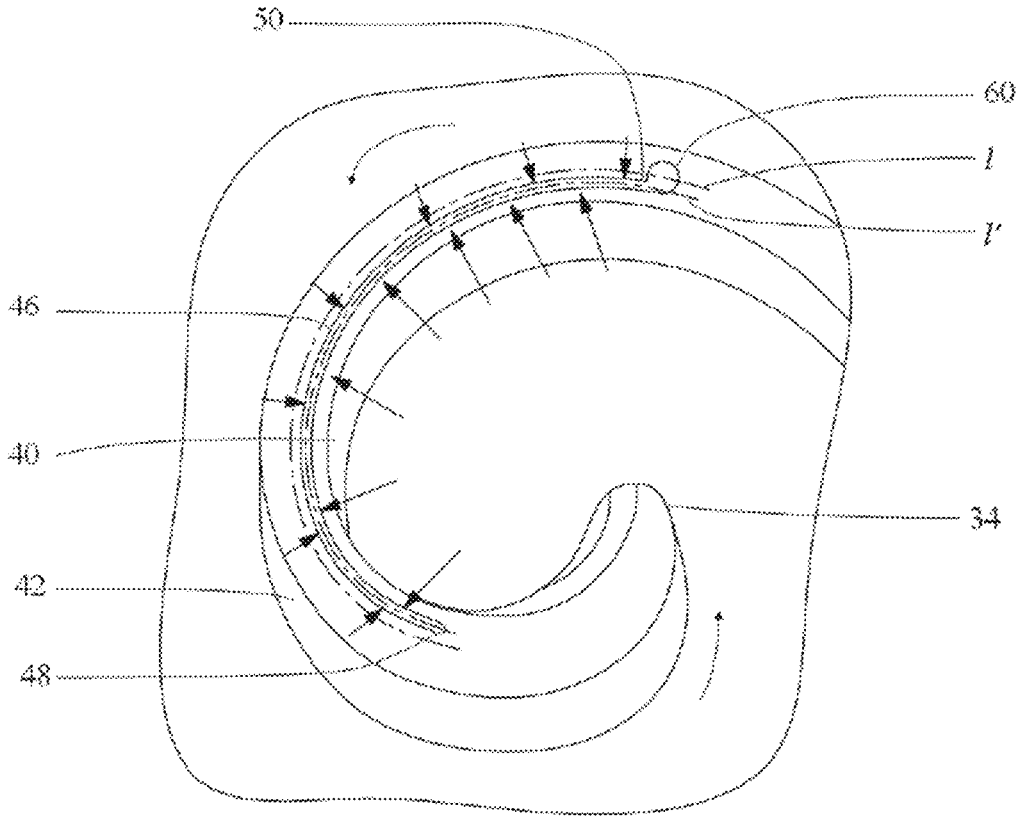
FIG. 2 is a partial perspective view of a dynamic vortex disk of a compressor related to the present application.

A pressure balancing mechanism is formed between the compression chamber 42 and the back pressure chamber 44, comprising a groove 46 and an air supply channel 52, as shown in FIG. 1-FIG. 2. The groove 46 is provided on the end surface 38. The air supply channel 52 passes through the interior of the dynamic vortex wall 34 until it opens to the back pressure chamber 44. The groove 46 extends substantially along the extension direction of the dynamic vortex wall 34, comprising a proximal end 48 proximate to the axis and a distal end 50 away from the axis. The proximal end 48 is closer to the center of the dynamic vortex disk 26 than the distal end 50. The groove 46 and the air supply channel 52 are connected at the distal end 50. The groove 46 is provided offset from the center l of the dynamic vortex wall 34, i.e., the groove 46 does not share the same center line as the dynamic vortex wall 34. That is, the slot 46 is provided proximate to one side 40 of the dynamic vortex wall 34 while distal from the other side 42 of the dynamic vortex wall 34.

A suction chamber 54 is formed between the side of the intermediate disk 22 opposite to the back pressure chamber 44 and the housing 10. The suction chamber 54 is connected to the peripheral space of the dynamic vortex disk 26 and the static vortex disk 14. As the main shaft 24 rotates about the axis X, the eccentric axis 56 with the axis X' drives the movement of the dynamic vortex disk 26 relative to the static vortex disk 14, and fluid is drawn in from the periphery of the dynamic vortex disk 26 and the static vortex disk 14 into the compression chamber 42 between the dynamic vortex disk 26 and the static vortex disk 14. As the rotation continues, the compression chamber 42 moves from the periphery towards the center and gradually decreases in volume, while the fluid inside the compression chamber 42 is progressively pressurized and eventually discharged as high-pressure fluid from the discharge outlet 20 at the center of the dynamic vortex disk 34 and the static vortex disk 14. Continuous vortex compression is achieved by repeating this cycle. It can be seen that the pressure of the fluid within the compression chamber 42 is a dynamic variant, and the fluid within the compression chamber 42 is typically progressively pressurized from the periphery towards the center.

Figure 3:
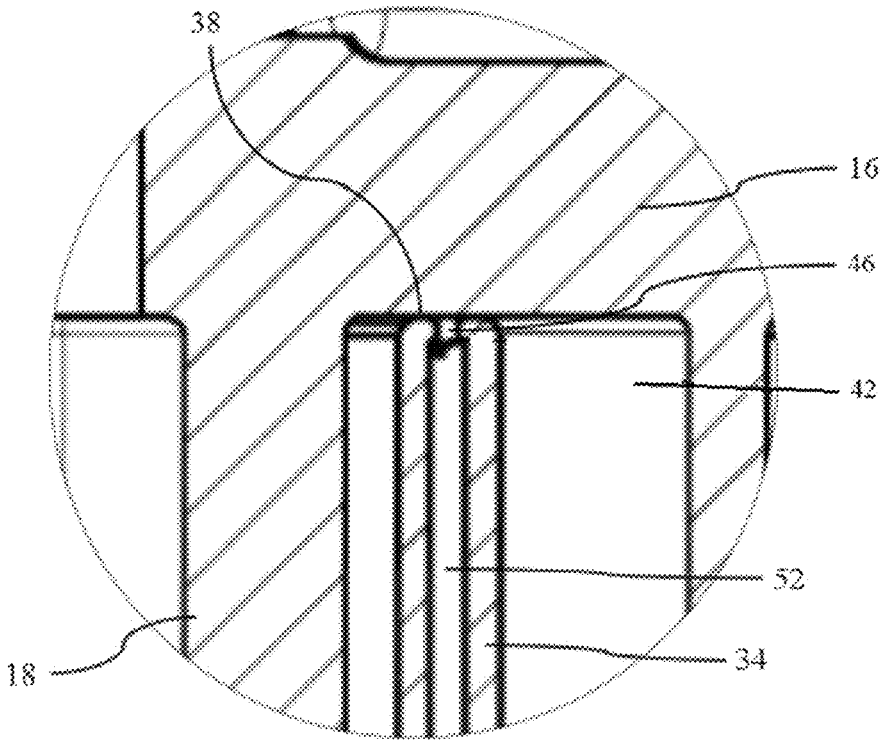
FIG. 3 is a schematic view of the compressor related to the present application in a first position.
Figure 4:
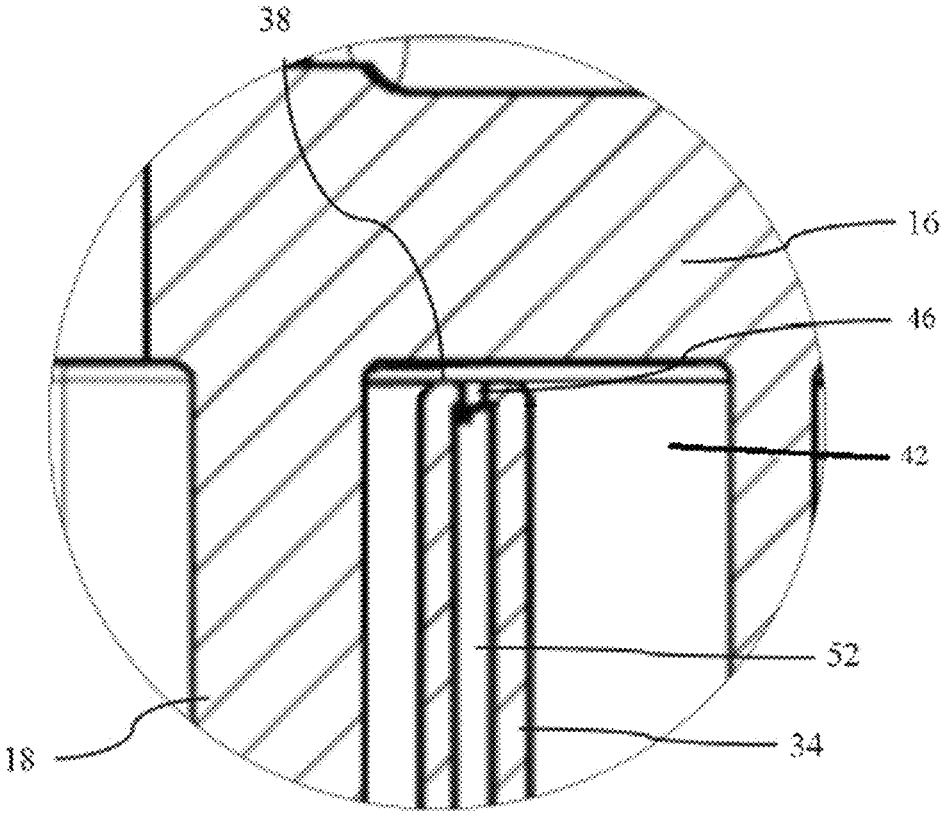
FIG. 4 is a schematic view of the compressor related to the present application in a second position.

The dynamically varying pressures of the fluid in the compression chamber 42 and the back pressure chamber 44 separately apply pressure on the dynamic vortex disk 26 from opposite directions. As shown in FIG. 1, the fluid in the compression chamber 42 applies pressure on the dynamic vortex disk 26 from top to bottom, while the fluid in the back pressure chamber 44 applies pressure on the dynamic vortex disk 26 from bottom to top. The pressures in both directions vary dynamically, and in the case when the pressures are equal in magnitude, the forces cancel each other out, achieving equilibrium, at which point the friction between the dynamic vortex disk 26 and static vortex plate 14 is minimized. A dynamic vortex disk 26 is axially mounted between the static vortex disk 14 and the intermediate disk 22 with a clearance fit. In the case of an imbalance in the magnitude of pressure between the compression chamber 42 and the back pressure chamber 44, the dynamic vortex disk 26 is capable of making minor movements in the axial direction between the first position and the second position between the static vortex disk 14 and the intermediate disk 22. If the pressure from the compression chamber 42 is less than the pressure from the back pressure chamber 44, the dynamic vortex disk 26 is in the first position, as shown in FIG. 3; the end surface 38 of the dynamic vortex wall 34 abuts the static substrate 16, the groove 46 is spaced apart from the compression chamber 42, and the high-pressure fluid in the compression chamber 42 does not enter the groove 46. If the pressure from the compression chamber 42 is greater than the pressure from the back pressure chamber 44, the dynamic vortex disk 26 moves downward to the second position, as shown in FIG. 4; the end surface 38 moves away from the static substrate 16, the groove 46 is connected to the compression chamber 42, and the high-pressure fluid in the compression chamber 42 enters through the groove 46 and enters the back pressure chamber 44 in a supplementary manner after passing through the air supply channel 52. At this point, the fluid in the back pressure chamber 44 is replenished and the pressure increases, and if the pressure from the back pressure chamber 44 is greater than the pressure from the compression chamber 42, the dynamic vortex disk 26 moves upward back to the first position. The cycle is thus repeated. It can be seen that, on the one hand, it is necessary to prevent the pressure from the compression chamber 42 from being too small compared to the pressure from the back pressure chamber 44 to prevent friction losses; on the other hand, it is important to prevent the pressure from the compression chamber 42 from being too high compared to the pressure from the back pressure chamber 44 to prevent leakage losses. Therefore, achieving a suitable relative balance between the pressure from the compression chamber 42 and the pressure from the back pressure chamber 44 is beneficial for increasing the compression efficiency of the compressor.

The groove 46 of the present application is provided eccentrically on the end surface 38 of the dynamic vortex wall 34, and fluid on one side of the dynamic vortex wall 34 proximate to the groove 46 is preferentially collected into the groove 46 compared to the other side (i.e., the side distal from the groove). The fluid in the compression chamber 42 is progressively pressurized as it flows towards the center along the dynamic vortex wall 34, so the fluid pressure at both sides of the dynamic vortex wall 34 is different. As shown in FIG. 2, the fluid pressure on the radial relative inner side 40 of the dynamic vortex wall 34 will be greater than that on the relative outer side 42. This is because the fluid first passes through the relative outer side 42 before reaching the relative inner side 40, so the position reached by the fluid at the radial inner side 40 is closer to the center than the position reached by it at the outer side 42. The groove 46 is positioned proximate to the relative inner side 40, allowing more of the higher pressure fluid at the relative inner side 40 to be collected into the groove 46.

Figure 5:
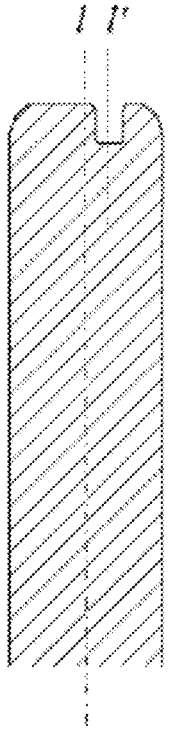
FIG. 5 is a cross-sectional view of a vortex wall of the dynamic vortex disk of the compressor related to the present application.
Figure 6:
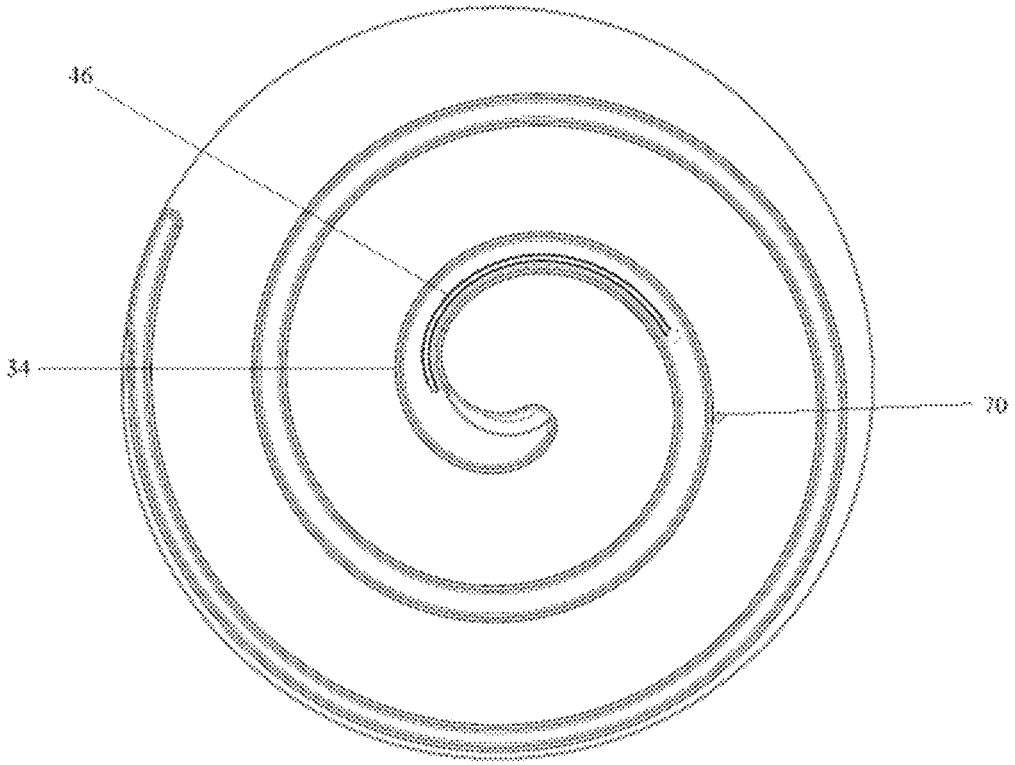
FIG. 6 is a schematic view of one example of a groove of the vortex wall of the dynamic vortex disk of the compressor related to the present application.
Figure 7:
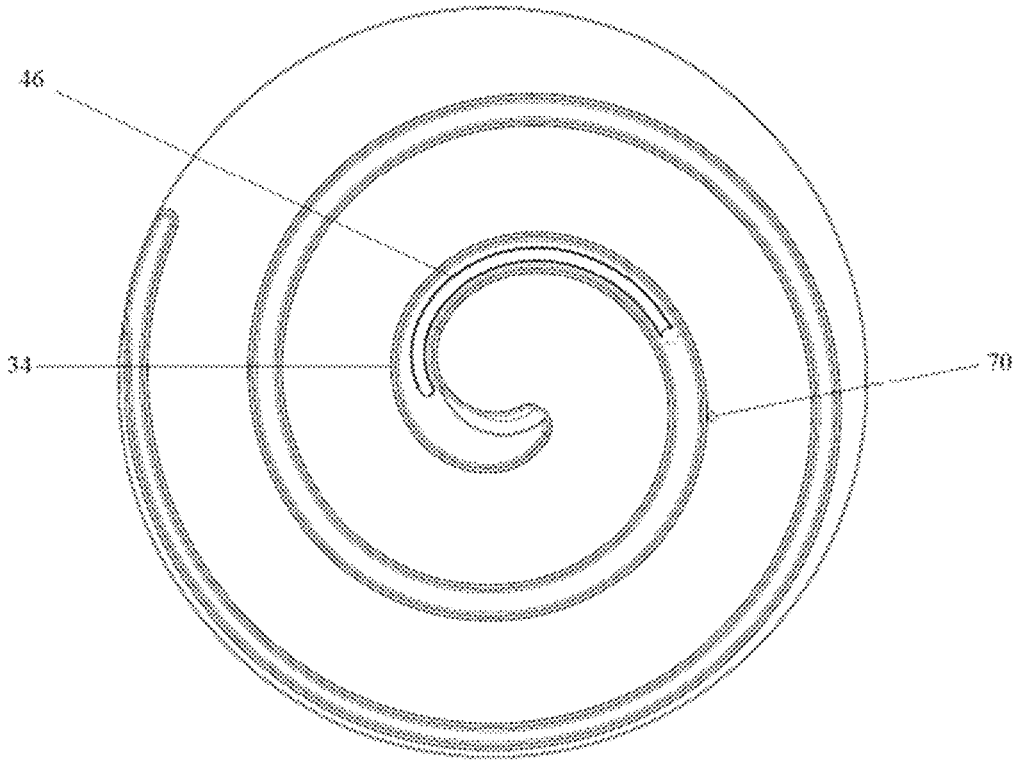
FIG. 7 is a schematic view of another example of the groove of the vortex wall of the dynamic vortex disk of the compressor related to the present application.

In one example, the centerline l' of the groove 46 deviates from the centerline l of the dynamic vortex wall 34 by a distance no less than 0.1 times the thickness of the dynamic vortex wall 34, and FIG. 5 illustrates this deviation. In another example, the centerline of the groove 46 may deviate by a distance of 0.1, 0.2, 0.3, 0.4, or 0.45 times the thickness of the dynamic vortex wall 34. In yet another example, the width of the groove 46 is no less than 0.1 times and no more than 0.9 times the thickness of the dynamic vortex wall 34. In yet another example, the width of the groove 46 is 0.1, 0.2, 0.3, 0.4, 0.5, 0.6, 0.7, 0.8, or 0.9 times the thickness of the dynamic vortex wall 34. FIG. 6 shows an example in which the width of the groove 46 is 0.3 times the thickness of the dynamic vortex wall 34. FIG. 7 shows an example in which the width of the groove 46 is 0.7 times the thickness of the dynamic vortex wall 34.

Figure 8:
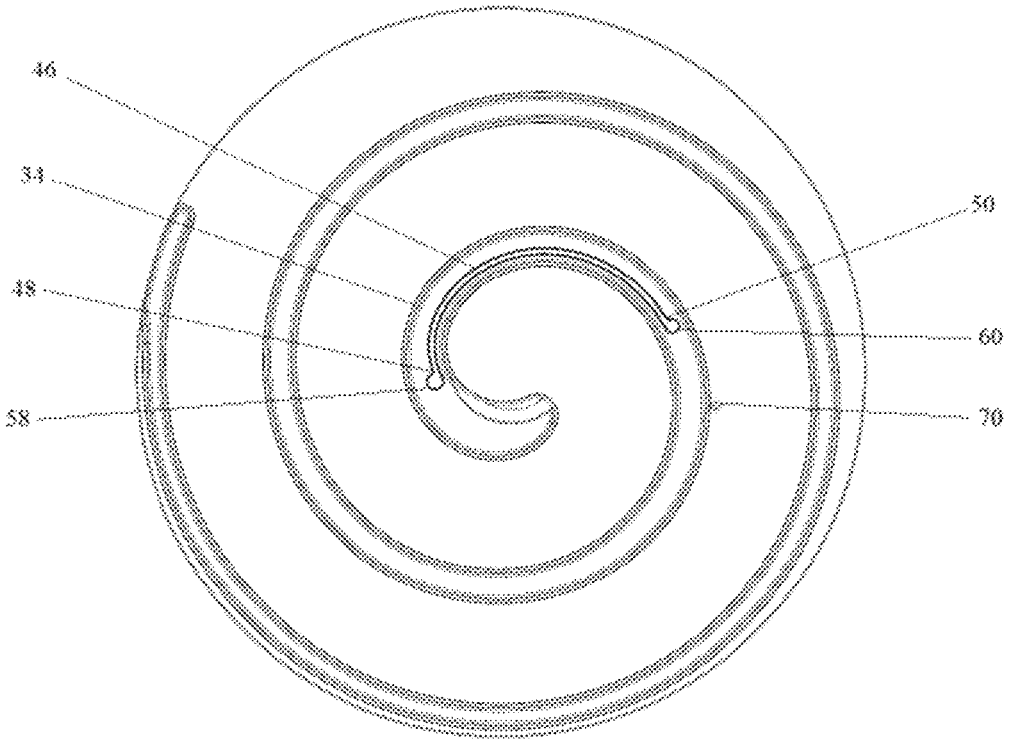
FIG. 8 is a schematic view of yet another example of the groove of the vortex wall of the dynamic vortex disk of the compressor related to the present application.

The groove 46 is provided with a suction aperture 58 at its proximal end 48, as shown in FIG. 8, wherein the suction aperture 58 is circular, with a diameter greater than the width of the slot 46, which facilitates the collection of high-pressure fluid, and the suction aperture 58 is positioned such that it is concentric with the dynamic vortex wall 34. The groove 46 is provided with a guiding port 60 at its distal end 50, which is also circular, wherein the guiding port 60 is also circular and directs fluid entering the groove 46 into the air supply channel 52. The diameter of the guiding port mouth 60 is greater than the width of the groove 46, and it is positioned to be at the center of the dynamic vortex wall 34. The groove 46 is positioned between the suction aperture 58 and the guiding port 60 and is offset from the centerline of the dynamic vortex wall 34.

The diameter of the air supply channel 52 is set to be equal to or close to that of the guiding port 60. The diameter of the air supply channel 52 is greater than the width of the groove 46, facilitating the passage of fluid. The air supply channel 52 runs along the axis of the dynamic vortex disk 26 and is positioned in the center of the dynamic vortex wall 34. The air supply channel 52 is also positioned on the radial outer side of the main shaft 24 of the compressor 42. In one example, the diameter of the air supply channel 52 is no less than 0.2 times and no more than 0.9 times the thickness of the dynamic vortex wall 34. For example, the diameter of the air supply channel 52 may be 0.3, 0.45, 0.5, 0.6, 0.7, or 0.8 times the thickness of the dynamic vortex wall 34.

Figure 9:
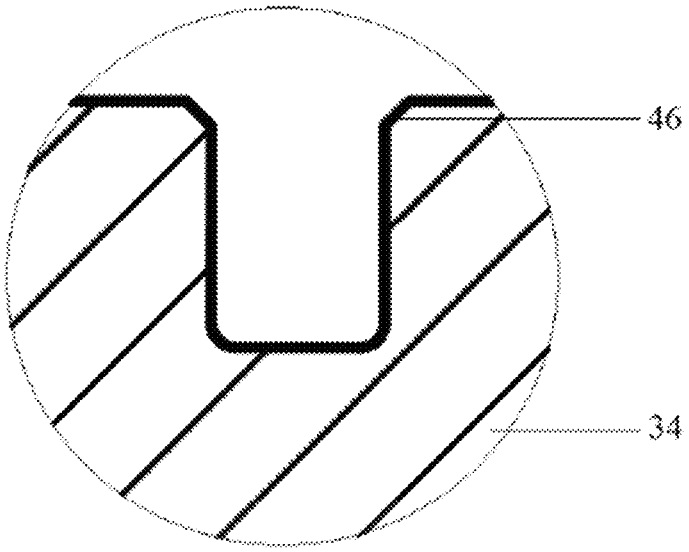
FIG. 9 is a cross-sectional view of one example of the vortex wall of the dynamic vortex disk of the compressor related to the present application.
Figure 10:
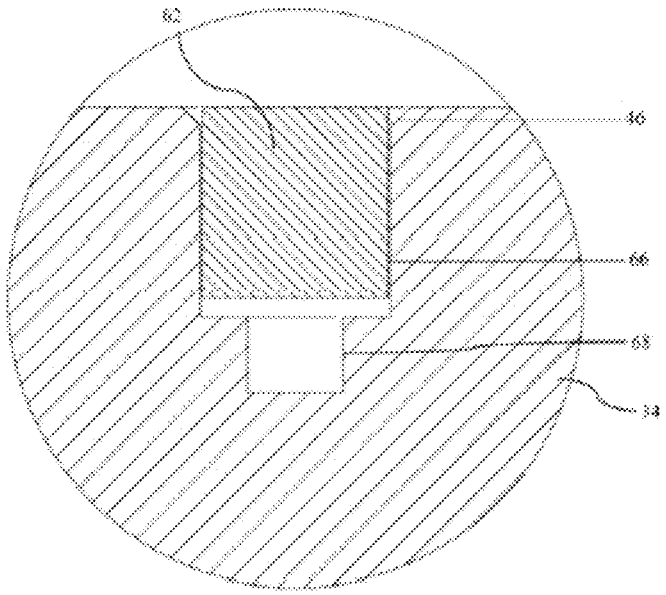
FIG. 10 is a cross-sectional view of one example of the vortex wall of the dynamic vortex disk of the compressor related to the present application.

In one example, the groove 46 is not provided with a sealing strip. In another example, the sealing strip 62 is added to the groove 46. The sealing strip 62 fills at least a portion of the length of the groove 46 between the proximal end 48 and the distal end 50 of the groove 46. FIG. 9 shows a cross-section of the groove 46 without the sealing strip, and as seen in the figure, the groove 46 has a constant width throughout its depth. FIG. 10 shows a cross-section of the groove 46 provided with the sealing strip 62, and as seen in the figure, the cross-section has a stepped profile, comprising an upper portion 66 of a narrower width and a lower portion 68 of a wider width. The sealing strip 62 fills the narrower upper portion 66 and is used to prevent fluid from entering the groove 46 from the filled portion. Without the sealing strip, the depth of the groove 46 may be made shallower.

In terms of length, the groove 46 extends over a wide span, allowing it to collect high-pressure fluid from the compression chamber 42 over a large range. The groove 46 extends around the axis for no less than 60 degrees and no more than 400 degrees from the proximal end 48 to the distal end 50. In one example, the groove 46 extends 60 degrees, 90 degrees, 110 degrees, 180 degrees, 220 degrees, 260 degrees, 300 degrees, 365 degrees, or 400 degrees around the axis from the proximal end 48 to the distal end 50 for. In another example, the outer diameter of the dynamic vortex disk 26 is no greater than 120 millimeters, for example, the outer diameter of the dynamic vortex disk 26 is 100 millimeters. In yet another example, the groove 46 extends around the axis for a length no less than 15 mm from the proximal end 48 to the distal end 50. In yet another example, the groove 46 extends around the axis for a length of 20 mm, 30 mm, 36 mm, 40 mm, 60 mm, 80 mm, 100 mm, or 150 mm from the proximal end 48 to the distal end 50.

When the groove 46 extends over a large span, the groove 46 does not need to be set very wide, which would remove excessive area from the end surface of the dynamic vortex wall 34, thereby reducing the strength of the dynamic vortex wall 34. This design also makes it easier to achieve effective sliding contact between the end surface 38 of the dynamic vortex wall 34 and the static substrate 16, thereby reducing leakage and increasing compression efficiency. The position of the air supply channel 52 may be implemented in a variety of ways depending on the extension span of the groove 46. The greater the extension span of the groove 46, the further the position of the air supply channel 52 from the main shaft 24 of the compressor, and such a configuration facilitates processing.

In one example, a throttle aperture 70 that runs in the axial direction is provided between the first side 30 and the second side 32, as shown in FIG. 6-FIG. 8. The radial distance from the throttle aperture 70 to the axis is no less than 0.3 times the radius of the dynamic vortex disk 26. When the pressure in the back pressure chamber 44 is too high, the throttle aperture 70 can be used to reflux the high-pressure fluid from the back pressure chamber 44 to the compression chamber 42, which has a lower pressure in the peripheral region, appropriately reducing the high pressure in the back pressure chamber 44. The aperture size of the throttle aperture 70 is less than 0.3 times the diameter of the air supply channel 52. Slowly refluxing the high-pressure fluid in the back pressure chamber 44 prevents fluid in the back pressure chamber 44 from leaking too quickly and maintains a high compression efficiency.

While specific examples of the present application have been shown and described in detail to illustrate the principles of the present application, it should be understood that the present application may be implemented in other ways without departing from such principles.

The invention claimed is:

1. A dynamic vortex disk (26) comprising:

a dynamic substrate (28) with a first side (30) and a second side (32) opposite to each other;

a dynamic vortex wall (34), which is integrally molded with the dynamic substrate (28), and extends around an axis of the dynamic substrate (28) at the first side (30) of the dynamic substrate (28) and away from the axis, the dynamic vortex wall (34) further has an end surface (38) opposite to the first side (30) and away from the second side (32);

a groove (46) deviating from a centerline of the dynamic vortex wall (34) and formed on the end surface (38), the groove (46) having a proximal end (48) close to the axis of the dynamic substrate (28) and an opposing distal end (50);

an air supply channel (52) configured to extend along the axis through an interior of the dynamic vortex wall (34) until the air supply channel (52) opens to the second side (32), with the groove (46) and the air supply channel (52) connected at the distal end (50).

2. The dynamic vortex disk according to claim 1, wherein the groove (46) is configured such that a centerline of the groove (46) deviates from the centerline of the dynamic vortex wall (34) by a distance of not less than 0.1 times a thickness of the dynamic vortex wall (34).

3. The dynamic vortex disk according to claim 1, wherein a width of the groove (46) is no less than 0.1 times a thickness of the dynamic vortex wall (34) and no more than 0.9 times the thickness of the dynamic vortex wall (34).

4. The dynamic vortex disk according to claim 1, wherein the groove (46) is configured to remain proximal to a radially relative inner side of the dynamic vortex wall (34) from the proximal end (48) to the distal end (50).

5. The dynamic vortex disk according to claim 4, wherein the groove (46) is further provided with a guiding port (60) at the distal end (50), the guiding port (60) being configured such that a diameter of the guiding port (60) is greater than a width of the groove (46), a center of the guiding port (60) coincides with the centerline of the dynamic vortex wall (34), and the air supply channel (52) is aligned with the center of the guiding port (60).

6. The dynamic vortex disk according to claim 4, wherein the groove (46) has a constant width throughout its depth.

7. The dynamic vortex disk according to claim 1, wherein the groove (46) is further provided with a suction aperture (58) at the proximal end (48), the suction aperture (58) being configured such that a center of the suction aperture (58) coincides with the centerline of the dynamic vortex wall (34).

8. The dynamic vortex disk according to claim 7, wherein the groove (46) is further provided with a sealing strip (62) between the proximal end (48) and the distal end (50), the groove (46) having a cross-section with a stepped profile, wherein the stepped profile comprises a narrow upper portion (66) and a wider lower portion (68), and the sealing strip (62) is configured to fill the upper portion (66).

9. The dynamic vortex disk according to claim 7, wherein the groove (46) is further provided with a guiding port (60) at the distal end (50), the guiding port (60) being configured such that a diameter of the guiding port (60) is greater than a width of the groove (46), a center of the guiding port (60) coincides with the centerline of the dynamic vortex wall (34), and the air supply channel (52) is aligned with the center of the guiding port (60).

10. A compressor comprising:

a housing (10) having an accommodating cavity (12);

a static vortex disk (14) fixed in the accommodating cavity (12), wherein the static vortex disk (14) comprises an integrally molded static substrate (16) and a static vortex wall (18), with a discharge outlet (20) provided at a center of the static substrate (16);

an intermediate disk (22) fixed in the accommodating cavity (12);

a dynamic vortex disk (26) according to claim 1, wherein the dynamic vortex disk (26) is mounted between the static vortex disk (14) and the intermediate disk (22), the end surface (38) of the dynamic vortex wall (34) is in sliding contact with the static substrate (16), and a side of the dynamic vortex wall (34) is engaged with a side of the static vortex wall (18);

a compression chamber (42) formed between the static vortex disk (14) and the first side (30) of the dynamic substrate (28), with the compression chamber (42) connected to the discharge outlet (20); and a back pressure chamber (44) formed between the second side (32) of the dynamic substrate (28) and the intermediate disk (22), with the air supply channel (52) connected to the back pressure chamber (44).

11. The compressor according to claim 10, wherein the dynamic vortex disk (26) is mounted on a main shaft (24) of the compressor via an eccentric axis (56) and moves along the axis between a first position and a second position, wherein in the first position, the end surface (38) of the dynamic vortex wall (34) abuts the static substrate (16); and in the second position, the end surface (38) of the dynamic vortex wall (34) is spaced apart from the static substrate (16), with the compression chamber (42) connected to the back pressure chamber (44).

* * * * *